US012228383B2

(12) United States Patent
Kuhn

(10) Patent No.: US 12,228,383 B2
(45) Date of Patent: Feb. 18, 2025

(54) INTERCEPTOR MISSILE AND METHOD FOR STEERING THE INTERCEPTOR MISSILE

(71) Applicant: Diehl Defence GmbH & Co. KG, Überlingen (DE)

(72) Inventor: Thomas Kuhn, Heiligenberg (DE)

(73) Assignee: Diehl Defence GmbH & Co. KG, Überlingen (DE)

( * ) Notice: Subject to any disclaimer, the term of this patent is extended or adjusted under 35 U.S.C. 154(b) by 122 days.

(21) Appl. No.: 18/301,381

(22) Filed: Apr. 17, 2023

(65) Prior Publication Data

US 2023/0251070 A1 Aug. 10, 2023

Related U.S. Application Data

(63) Continuation of application No. PCT/EP2021/077884, filed on Oct. 8, 2021.

(30) Foreign Application Priority Data

Oct. 21, 2020 (DE) ..... 10 2020 006 465.5

(51) Int. Cl.
*F42B 10/60* (2006.01)
*F41H 11/02* (2006.01)

(52) U.S. Cl.
CPC ..... *F42B 10/60* (2013.01); *F41H 11/02* (2013.01)

(58) Field of Classification Search
CPC ..... F42B 10/60; F41H 11/02; F41G 7/224
See application file for complete search history.

(56) References Cited

U.S. PATENT DOCUMENTS 5,435,503 A * 7/1995 Johnson, Jr. ..... F41G 7/2246 701/3
5,637,826 A * 6/1997 Bessacini ..... F41G 7/32 114/21.1

(Continued)

FOREIGN PATENT DOCUMENTS

CN 112256055 A 1/2021
DE 102010032281 A1 1/2012

(Continued)

OTHER PUBLICATIONS

Zhou Jin et al, "Optimal midcourse trajectory planning considering the capture region," in Journal of Systems Engineering and Electronics, vol. 29, No. 3, pp. 587-600, Jun. 2018, doi: 10.21629/JSEE.2018.03.16. (Year: 2018).*

*Primary Examiner* — Bernarr E Gregory
(74) *Attorney, Agent, or Firm* — Laurence A. Greenberg; Werner H. Stemer; Ralph E. Locher

(57) ABSTRACT

A method for steering a steerable interceptor missile driven by an engine for intercepting a moving target during a midcourse phase of an interception, includes steering the missile with real steering commands produced at respective steering times based on free control parameters formed as a current parameter vector. The free control parameters are constantly and repeatedly optimized during the midcourse phase by an optimization method for optimizing the control parameters. The optimization method is carried out in parallel with the actual steering. Newly detected information about the movement of the target and/or information about the flight of the missile is used in the optimization method as soon as the information is available. Optimized control parameters are accepted into the current parameter vector after being provided by the optimization method. An inter- (Continued)

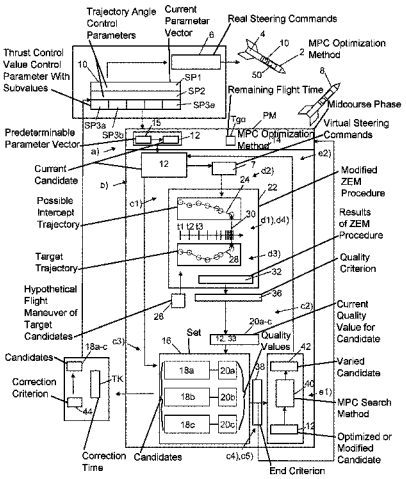

ceptor missile contains the current parameter vector and a control and evaluation unit for carrying out the method.

15 Claims, 1 Drawing Sheet

(56) References Cited

U.S. PATENT DOCUMENTS

| | | | | |
|---|---|---|---|---|
| 6,768,927 | B2 * | 7/2004 | Krogmann | G05B 13/027 700/47 |
| 7,513,455 | B1 | 4/2009 | Mavroudakis et al. | |
| 7,968,831 | B2 * | 6/2011 | Meyer | F41G 7/2253 701/1 |
| 8,106,340 | B1 * | 1/2012 | Diaz | F42B 15/10 342/61 |
| 8,710,411 | B1 | 4/2014 | LaPat | |
| 10,317,852 | B1 * | 6/2019 | Spooner | F42B 15/10 |
| 10,663,260 | B2 * | 5/2020 | Choiniere | F41G 7/2253 |
| 2020/0039577 | A1 * | 2/2020 | Kataoka | B62D 6/008 |

FOREIGN PATENT DOCUMENTS

| | | | |
|---|---|---|---|
| EP | 2423774 | A1 | 2/2012 |
| JP | 2011220625 | A | 11/2011 |

* cited by examiner

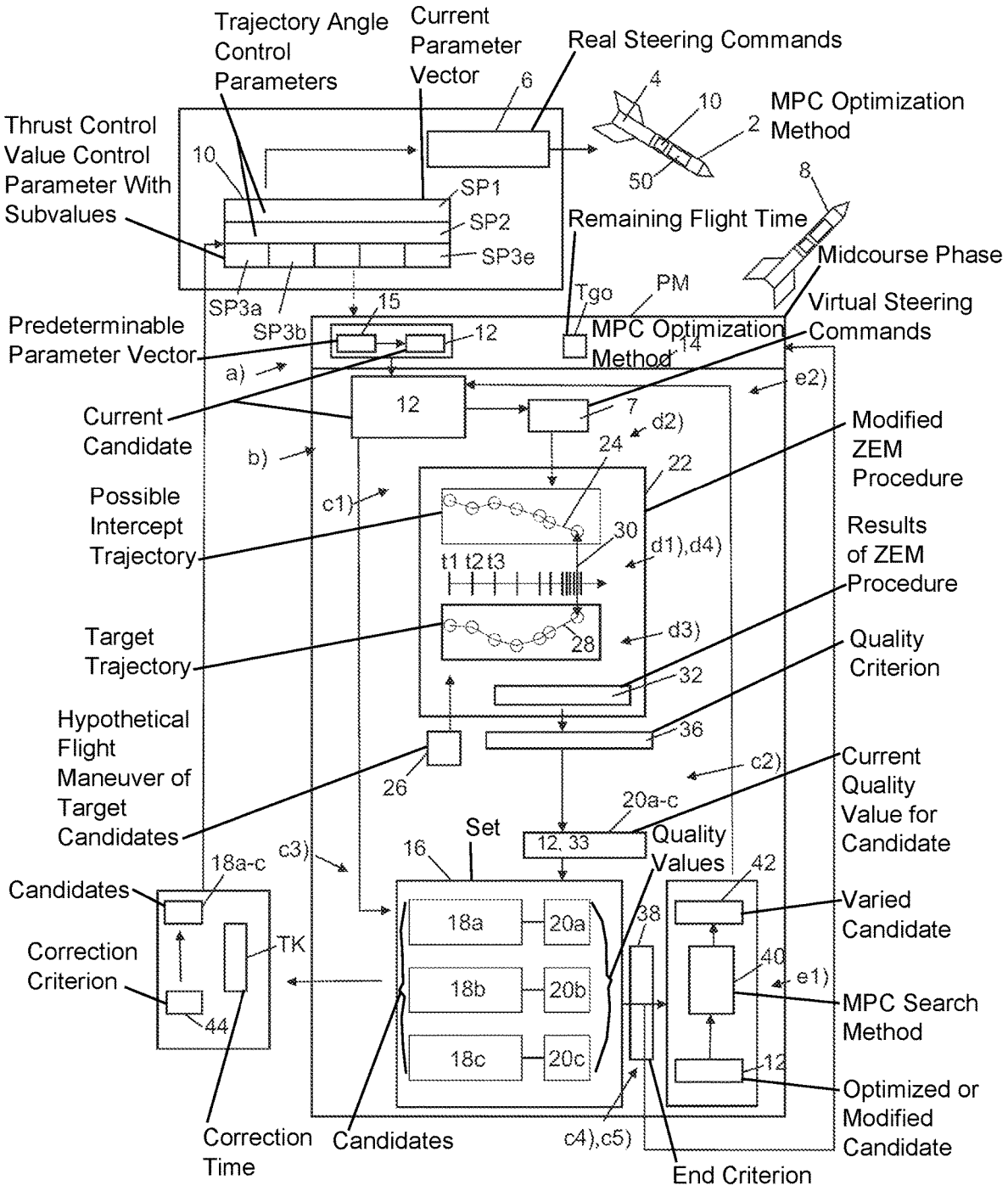
Trajectory Angle Control Parameters
Current Parameter Vector
Real Steering Commands
MPC Optimization Method
Thrust Control Value Control Parameter With Subvalues
Remaining Flight Time
Midcourse Phase
Virtual Steering Commands
Predeterminable Parameter Vector
MPC Optimization Method
Current Candidate
Modified ZEM Procedure
Possible Intercept Trajectory
Results of ZEM Procedure
Target Trajectory
Quality Criterion
Hypothetical Flight Maneuver of Target Candidates
Current Quality Value for Candidate
Set
Quality Values
Candidates
Varied Candidate
Correction Criterion
MPC Search Method
Optimized or Modified Candidate
Correction Time
Candidates
End Criterion
SP1
SP2
SP3e
SP3a
SP3b
Tgo
PM
a)
b)
c1)
c2)
c3)
c4),c5)
d1),d4)
d2)
d3)
e1)
e2)
t1 t2 t3
TK

INTERCEPTOR MISSILE AND METHOD FOR STEERING THE INTERCEPTOR MISSILE

CROSS-REFERENCE TO RELATED APPLICATION

This application is a continuation, under 35 U.S.C. § 120, of copending International Patent Application PCT/EP2021/077884, filed Oct. 8, 2021, which designated the United States; this application also claims the priority, under 35 U.S.C. § 119, of German Patent Application DE 10 2020 006 465.5, filed Oct. 21, 2020; the prior applications are herewith incorporated by reference in their entirety.

FIELD AND BACKGROUND OF THE INVENTION

The invention relates to steering a steerable interceptor missile propelled by an engine for intercepting a moving target, in particular a target missile, during a midcourse phase of the interception and the invention also relates to such an interceptor missile.

An interceptor missile is launched to defend against a moving target, in particular an approaching target missile. After a launch phase, in which the interceptor missile leaves its launch base and takes up its flight roughly towards the target, the midcourse phase of its flight follows. That serves to travel most of the distance to the target and to get close to it, in particular so close that on-board systems of the interceptor missile are sufficient to be able to hit the target accurately in an endgame following the midcourse phase.

German Patent Application DE 10 2010 032 281 A1 discloses a method for controlling a steered missile propelled by an engine, in which a process device of the steered missile calculates a trajectory property of a trajectory to a target point during the flight and controls the flight of the steered missile depending on the trajectory property. When calculating the trajectory property, unguided flight processes influencing the airspeed of the steered missile and controlled by the process device are taken into account. The inclusion of future or present flight processes controlled by the process device in the flight control on the basis of proportional navigation is possible, but complex. Such inclusion is easier if the process device uses miss-point navigation instead of proportional navigation, especially a technique called zero effort miss (ZEM) navigation.

SUMMARY OF THE INVENTION

It is accordingly an object of the invention to provide an interceptor missile and a method for steering the interceptor missile, which overcome the hereinafore-mentioned disadvantages of the heretofore-known missiles and methods of this general type and which propose improvements with respect to the interceptor missile or the steering of the interceptor missile in the midcourse phase of its flight to a moving target.

With the foregoing and other objects in view there is provided, in accordance with the invention, a method for steering a steerable interceptor missile powered by an engine for intercepting a moving target during a midcourse phase of the interception, in which:

- the interceptor missile is steered by real steering commands, which are generated at respective steering times on the basis of free control parameters, which are available in the form of a current parameter vector,

- the free control parameters are constantly and/or repetitively optimized in the course of the midcourse phase by an optimization procedure for optimizing the control parameters,
- the optimization procedure takes place in parallel with the actual steering,
- newly detected information about the movement of the target and/or information about the flight of the interceptor missile are included in the optimization procedure as soon as they are available, and
- optimized control parameters are taken into the current parameter vector once they are available from the optimization procedure.

Preferred or advantageous embodiments of the invention, as well as other categories of invention, result from the further claims, the following description and the attached figures.

The interceptor missile or its flight is used to intercept a moving target, in particular a target missile. The steering method can be referred to as model predictive guiding. It is performed during a midcourse phase of the interception. The midcourse phase is the phase of the flight of the interceptor missile from its launch to entry into the endgame. The endgame begins with the activation of the on-board homing sensors (seeker head). During the midcourse phase, the target data originate in particular from the sensors of the higher-level weapon system and are transmitted to the interceptor through a data link. The desired successful strike on the target represents the end of the mission. Alternatively, a mission termination (mission end) takes place if the target cannot be reached or is finally missed or entry into the endgame is not possible or the interception is aborted or terminated for other reasons. Then the proposed control procedure also ends.

The interceptor missile is actually or really steered as follows: At the respective steering times, the interceptor missile generates real steering commands for itself on the basis of free control parameters currently available at the time of flight in the interceptor missile, which are available in the form of a parameter vector. "Real" means that the interceptor missile is actually steered with the help of these steering commands generated in this way. Optionally, additional values can also be introduced into the steering commands, for example (free) parameters that are not part of the parameter vector. The method assumes that when the interceptor missile enters the midcourse phase, i.e. when it is already in flight, or from this point in time and expediently until the end of the midcourse phase or beyond, there is always a current parameter vector of free control parameters available to the interceptor missile, from which the real steering commands are then generated. This parameter vector forms in particular a suitable initial value for steering, possibly also for optimization, as explained below.

The free control parameters are constantly and/or repeatedly optimized during the midcourse phase with the help of an optimization procedure for optimizing the control parameters. This optimization or the optimization procedure takes place in parallel with the actual steering. This can be understood to mean that the control parameters in the current parameter vector (basis of the real steering) initially remain unchanged. In this case, the parameters currently used for steering are not optimized directly, but—figuratively speaking—a copy or image of these control parameters or the parameter vector is optimized outside the actual steering procedure. In this respect, the optimization can also take place independently of the actual steering, which does not have to be influenced by the optimization taking place in parallel at first.

Newly detected information about the movement of the target and/or information about the flight of the interceptor missile are included in the optimization procedure as soon as they are available. The optimization procedure can therefore always be based on the most up-to-date and best available data about the circumstances of the current mission.

Optimized control parameters are then transferred to the current parameter vector after, in particular as soon as, they are available as a result of the optimization method. Only when the optimized parameters have been transferred to the current parameter vector, which forms the basis of the real steering, do the optimized control parameters influence the actual steering. As the above indicates, only then is the optimized copy of the parameter vector integrated, transferred or taken over into the parameter vector actually used for steering.

The invention is based on the following core concept:

An interceptor missile is steered in the midcourse phase in order to hit a mobile and in particular (potentially) maneuvering target. For this purpose, the real steering commands are calculated from a vector (parameter vector) of free (control) parameters. These free parameters can be target trajectory angles, but they can also be setpoints for the lateral acceleration. In addition, in the case of a multi-stage engine, the ignition timings of the respective stages can be treated as free parameters or, in the case of a controllable engine, the target thrust or the discrete-time target thrust profile. The invention is based on the concept that these free parameters are constantly and/or repetitively optimized using a search method for parameter optimization in the course of the midcourse phase. This optimization takes place independently of and in parallel with the actual steering. Whenever new information about the target movement or the flight trajectory of the interceptor (interceptor missile) is available, it is included in the optimization to determine better, ideally optimal parameters. The improved parameters are used by the actual steering as soon as they are available.

The following exemplary embodiments or variants of the invention are conceivable:

The optimization is carried out in particular with regard to a target function (quality function/criterion/quality value), which in turn is based on a Zero Effort Miss (ZEM) prediction of the trajectories of the target and the interceptor. As soon as the closest approach of the target and the interceptor (ZEM) is reached, the prediction (modified ZEM method) is aborted. The resulting trajectories are evaluated by the target function (quality value). For example, it evaluates how close the interceptor comes to the target (ZEM), the speed of the interceptor at the end of its trajectory (maneuverability in the endgame), how long the combat takes (Tgo), and the angle at which the target and the interceptor meet and any other sub criteria.

The prediction of the target trajectory, i.e. the trajectory of the target, is carried out based in particular on suitable hypotheses. For example, the target can be assumed to continue the current maneuver until it reaches a minimum approach speed and then continue to fly straight with maximum thrust (evasive maneuver). Or there is information about possible targets that suggests corresponding target maneuvers. Likewise, the target can be assumed to have a ballistic or pseudo ballistic trajectory. The hypotheses on the target trajectory are based on prior knowledge and the observation of the target trajectory up to the present time. There is extensive literature on this. The formation and use of hypotheses are not a subject matter of this invention.

In the prediction of the interceptor trajectory, in particular, the free parameters to be optimized are used, for example, by converting the target trajectory angles or the setpoints for the lateral acceleration by a behavioral model of the missile, in the case of a multistage engine the ignition times of the stages are selected accordingly and in the case of a controllable engine the thrust or thrust profile is adjusted accordingly. In particular, the fuel consumption and the loss of mass as well as the existing restrictions (minimum and maximum controllable thrust, no thrust after the fuel is consumed) are taken into account as well as resistance and gravity in the well-known ZEM method. In particular, step size control ensures that events such as the ignition of an engine stage or the achievement of the ZEM are precisely calculated in time.

Since the calculation of the target function always includes the relatively complex step-size-controlled simulation of the combat, it is particularly useful to use search methods that achieve the optimum or at least a significant improvement with relatively few iterations. For this purpose, gradient-based methods are rather unsuitable due to the necessary approximation of the gradient by difference quotients. The simplex method according to Nelder Mead has proven to be very robust. This has been known in the prior art for about 60 years.

According to the invention, due to the continuously updated control parameters and their use for real steering, improved steering of the interceptor missile towards the target is achieved.

In a preferred embodiment of the method, the following optimization procedure is carried out, wherein the steps or the procedure can be terminated or aborted at the end of the midcourse phase. This is followed by steering of the interceptor missile in the endgame, which—like the launch phase—is not part of the present patent application.

In a step a), a predefinable or predefined parameter vector is selected as the current candidate of an MPC optimization method (Model Predictive Control). The MPC method is used for the potential determination of improved control parameters compared to the predetermined parameter vector. The current candidate thus forms a starting value for an optimization of the control parameters using the MPC method.

In a step or procedure section b) a set of possible candidates (first and further subsequent candidates) for an improved parameter vector is determined in or by carrying out the MPC optimization method as follows; each of the candidates is assigned a quality value, which is also determined as part of the MPC procedure. The set can contain any number of candidates, wherein there may only be one candidate which is always replaced, for example, if there is a better candidate. The number of candidates to be used is merely a question of the selected optimization method. Of course, powerful methods work with several candidates. For example, the widely used method according to Nelder-Mead operates with a simplex of n+1 parameter vectors, wherein n denotes the length of the parameter vector. However, this has no role for the concept of the MPG or the present invention. Even a "stupid" method of random search according to the device of randomly varying the current parameter vector, evaluating the result and continuing with the variation as the new current parameter vector in the event of an improvement would work. (Apart from the excessive computing time.) The set thus includes in particular 1 to n candidates, wherein n depends on the optimization method, which, however, is not the subject matter of the invention.

Section (b) of the procedure includes steps (c1) to (c5):

In a step or procedure section c1), a modified ZEM procedure (Zero-Effort-Miss) is carried out on the basis of the current candidate as follows. The modified ZEM procedure includes steps d1) to d4):

In a step or procedure section d1), iterative predictions are made as follows at the respective step times; procedure step d1) includes steps d2) to d4):

In a step d2), a possible interception trajectory of the interceptor missile is predicted, taking into account the steering of the interceptor missile based on the current candidate. The steering is carried out based on virtual steering commands, which are only generated as part of the optimization procedure but are not used for the real steering of the interceptor missile. Instead, the steering commands serve to virtually determine the predicted trajectory. However, the generation of the virtual steering commands can be identical to the generation of the real steering commands. This creates a realistic simulation of the trajectory.

In a step d3), a possible target trajectory of the target is predicted on the basis of hypothetical maneuvers of the target.

In a step or loop d4), steps d2) to d3) are repeated iteratively until a ZEM approach of the interception trajectory and the target trajectory is achieved. After the end of the loop, both trajectories (and possibly a corresponding remaining flight time, see below) are available until the ZEM is reached (i.e. the minimum distance between the trajectories, ideally zero, if the interceptor missile can actually reach the target according to the prediction). The procedure now proceeds as follows with step c2):

In a step c2), based on the results of the ZEM procedure (the results are in particular: trajectories, ZEM, predicted duration Tgo of the flight along the trajectories until reaching the ZEM, etc.), a current quality value is determined on the basis of a quality criterion and is assigned to the current candidate.

In a step c3), the current candidate is collectively placed as the first or further candidate in the set of candidates. The current quality value is assigned to the candidate as the quality value and is also stored in the set. On reaching the step c3) for the first time, a first pair of values formed of a candidate and a quality value is stored, on reaching the next time (see below) a second, then a third, etc., until the MPC procedure is completed and thus the set of candidates is available. For example, after ten runs of steps c1) to c4), these are ten candidates with their quality values.

In a step c4), the availability of an end criterion of the optimization or the MPC optimization procedure is checked. If this has not yet been achieved, i.e. the MPC optimization procedure has not yet completed its optimization of the current candidates or candidates in the set, the two steps e1) and e2) are carried out:

In the step e1), the current candidate is varied to a varied candidate using an MPC search procedure. The first candidate thus becomes a second candidate, the second a third, and so on. The search procedure is used for the numerical optimization of the free parameters.

In the step e2), the newly determined varied candidate is henceforth adopted as the current candidate and the procedure is continued with step c1) or is returned to it.

In a step c5), which is the alternative to step c4), namely if the end criterion is reached, the procedure continues with step f):

In a step (f) the procedure returns to step (a) and continues there.

During the entire midcourse phase or the execution of the aforementioned procedure steps (in a certain sense parallel to this), one of the currently available candidates is selected at predetermined correction times according to a correction criterion and the current parameter vector is replaced by the selected candidate. As a result, optimized control parameters are transferred to the current parameter vector. From this point on, the generation of the real steering commands can then take place on a modified basis, namely on the basis of a changed parameter vector or a parameter vector improved in relation to the target or optimized control parameters.

Optionally, in step c3), one or more of the candidates determined in the MPC procedure are discarded according to a rejection criterion and removed from the set together with their quality values. In this way, the set is kept suitably small and unnecessary candidates are removed.

The "modification" of the ZEM method is therefore such that in a conventional or known or customary ZEM method both virtual steering of the interceptor missile using a parameter vector in the form of the current candidate is taken into account, as well as hypothetical maneuvers for the target trajectory of the target.

The procedure begins after launch, i.e. when the interceptor missile is already in flight. At the time of the start of the procedure, it can therefore be assumed that a current parameter vector already exists, which serves to steer the interceptor missile in the launch phase. The current parameter vector at the end of the launch phase can therefore be selected in particular as the predeterminable parameter vector of the method.

The procedure can be terminated when the midcourse phase ends and endgame steering begins. Both the MPC and the ZEM method are known in various forms in the prior art, so that these are not explained in more detail herein. Any manifestations of the respective known individual methods can be used and combined in embodiments of the invention. In particular, for example, control of the prediction step size in the ZEM method is carried out according to known procedures, for example in such a way that the time steps become smaller when approaching the target. Suitable "hypothetical maneuvers" of the target are in particular: unaccelerated movement (zero effort), ballistic trajectory profile, known or suspected evasive maneuvers or any other a priori knowledge about the target. In addition to the free parameters, passive effects such as non-controllable thrust, decreasing weight depending on fuel consumption, air resistance, etc. are taken into account when determining the trajectory of the interceptor missile and/or the target.

According to one embodiment of the invention, zero effort-miss steering (ZEM) is combined with the model predictive control (MPC) approach. The control parameters for configuring the trajectory of the interceptor missile are optimized constantly (correction time) and online (i.e. during the course of the midcourse phase, by the interceptor missile itself) using prediction models for the target (step d3), a predicted profile of the trajectory based on suspected maneuvers, etc. and the interceptor missile (interceptor, step d2, predicted profile of the trajectory based on the steering model, etc.).

The method can therefore also be referred to as "Model Predictive Guidance (MPG)."

According to the method, it is possible to use an estimate of the target acceleration (hypothetical maneuver) for the steering of the interceptor missile. The proposed method forms a starting point for the steering of a missile approaching over a long distance with a controllable thrust profile (according to a free parameter), such as an interceptor missile based on a ramjet drive (ramjet interceptor).

According to one embodiment of the invention, a modified MPC is applied in the field of missile steering. According to one embodiment of the invention, the combination of MPC and ZEM prediction modified and interacting in this way results for steering an interceptor missile (interceptor).

According to one embodiment of the invention, during the midcourse phase in particular two procedures or processes run side by side or in parallel and in a certain way independently of each other: The first process is the generation of steering commands based on a currently available (at the moment of generation of the steering command) parameter vector. The second process is the optimization of the parameter vector. Using the MPC method, a set of possible alternative parameter vectors is generated and each of these parameter vectors is evaluated with a quality value. Within the MPC method, a modified ZEM prediction is used. On the basis of the second procedure, if appropriate, namely if such a parameter vector is found, an optimized parameter vector (for example a better quality value than the first parameter vector, which corresponds to the current one from the steering command generation) is selected and the current parameter vector is replaced in the first process by the optimized parameter vector. In the first process, the steering commands are generated on the basis of the improved, replaced parameter vector.

The two processes run independently of each other, in particular in that a certain number of steering commands are generated from one and the same parameter vector before the parameter vector from the second process is replaced at a later date. The reason for this is, for example, that the MPC method takes a certain amount of time before an improved parameter vector is found, but in the meantime steering commands continue to be generated at shorter intervals.

In a preferred embodiment, as already explained above, in step a) the predeterminable parameter vector is predetermined in that the last current parameter vector of a launch phase preceding the midcourse phase is selected as the predeterminable parameter vector. In an alternative embodiment, a parameter vector is selected that corresponds to the prediction of a direct approach to the target. In particular, two MPC evaluations are carried out based on these two different first candidates and the parameter vector which leads to the better quality value (quality, quality measure) is selected as the first candidate This ensures good starting conditions for the MPC procedure in the midcourse phase.

In a preferred embodiment, the achievement of the end criterion in step c5) is selected as the correction time and—as a correction criterion—the candidate from the set to which the best quality value is assigned is selected. Thus, the end of the optimization is waited for and only then is the real parameter vector used for steering replaced. This new parameter vector is the best (best quality value) for target steering that could be determined on the basis of the optimization.

In a preferred embodiment, step c3) is selected as the correction time and additionally in step c3)—as a correction criterion—the current candidate (which has just been or is stored as a candidate in the set together with its quality value) is adopted as the current parameter vector, if its assigned quality value is the best of all quality values previously in the set so far. Thus, a respective update of the current parameter vector, i.e. that used for the real generation of steering commands, is carried out not only after completion of the optimization procedure (step c5)), but already during its processing. Optimizations are thus incorporated into the steering behavior and thus the trajectory of the interceptor missile earlier.

This strategy of replacing the current parameter vector according to the mentioned alternatives can also be varied for different procedure runs of the MPC procedure.

In a preferred embodiment, in step e1) the variation to a further or varied candidate is carried out at least partially on the basis of the previous candidates and their quality values. One or more or all of the candidates/quality values determined so far in the MPC procedure or set are therefore used in the search procedure to enable an improved determination of a next potential candidate.

In a preferred embodiment, the quality criterion contains at least as a sub criterion: a minimum deviation from the target (ZEM, closest approach to/distance of the interceptor missile from the target) and/or a maximum final velocity upon impact on the target and/or a minimum remaining flight time to the target and/or a desired angle of impact on the target. The corresponding sub-criteria or their resulting values are in particular allocated evaluation factors in order to ultimately generate a quality value. All these sub-criteria are ultimately decisive for a successful or even as effective as possible approach to/combatting of the target.

In a preferred embodiment, the method is configured for an interceptor missile whose engine is a solid booster or a dual-pulse engine or a controllable engine. In the case of a solid booster, the method takes into account in particular its residual burning time remaining for the midcourse phase in step d2). In the case of a dual-pulse engine, in particular its ignition timing for the ignition of the second engine stage is taken into account as a free parameter in the parameter vector and optimized in particular within the framework of the MPC method. In the case of a controllable (or adjustable) engine, for example a ramjet, in particular its thrust control value or the profile of the thrust control value over time is taken into account as a free control parameter in the parameter vector and in particular is optimized. For all three variants, in particular the weight of the interceptor missile decreasing with fuel consumption is taken into account in step d2).

In a preferred embodiment, a currently predicted remaining flight time of the interceptor missile until its end of the mission is additionally determined in step a). The end of the mission is in particular the strike on the target or reaching a minimum distance to the target (ZEM). This remaining flight time (also "Tgo") can optionally be used as a free control parameter and/or as a sub criterion for the quality criterion (for example the shortest possible remaining flight time) and/or for determining step sizes in the ZEM method. As part of the ZEM prediction, a current remaining flight time can then also be determined, namely as the time when the ZEM is reached.

In a preferred variant of this embodiment, a parameter vector with which at least one of the free parameters is a value oriented to the remaining flight time or a sequence of sub values oriented to the remaining flight time is used as the current parameter vector and thus in particular also as a predeterminable parameter vector and/or as a current candidate, etc. A suitable value is, for example, the aforementioned ignition time for a dual-pulse engine. A sequence of sub values is selected, for example, for the thrust control value (as a free parameter) of a controllable engine as follows: in an optimization method, the remaining flight time to the target is divided into n, for example n=5, in particular equally long time periods and each time period is consistently assigned a certain thrust control value as a sub value. In the optimization method, a thrust profile in n or five steps (corresponding to the time periods) is used and optimized in step d2) for the prediction of the trajectory of the interceptor missile. In particular, a free control parameter is available with a variable thrust profile in order for the interceptor missile to be able to react particularly well to highly agile evasive maneuvers of the target. For this method variant, therefore, the most up-to-date remaining flight time of the interceptor missile to the target is always predicted.

In a preferred variant of this embodiment (in the alternative or variant of a sequence of sub values)—as explained above by way of example—in step d2) the predicted remaining flight time is therefore taken into account in such a way that it is divided into a predetermined number of time periods in the ZEM method, and a different one of the sub values is taken into account for each time period. As explained above, the parameter vector thus contains a free parameter, which in turn is formed from a value sequence of the sub values and, for example, represents a thrust profile in 5 stages/time periods.

In a preferred variant of this embodiment—as already explained above analogously—the value or the sub values is an ignition time dependent on the remaining flight time or determined by reaching a specific point in time or several ignition times of a respective first or further combustion stage of one or more engines of the interceptor missile. This embodiment is suitable for interceptor missiles containing one or more single-stage or multistage engines, wherein such an engine stage may be assigned its own ignition time to be optimized.

In a preferred variant of this embodiment, at least one of the values or sub values is—as already explained above—a thrust control value dependent on the remaining flight time for an engine controllable with regard to its thrust of the interceptor missile. In this case the dependency is formed, for example, of a section-by-section or continuous variation of the thrust during the remaining flight time.

In a preferred variant of this embodiment, at least one of the sub values is a control value dependent on the remaining flight time for a lateral acceleration element of the interceptor missile. The control of a corresponding lateral acceleration element leads to a lateral acceleration, i.e. a change of direction of the interceptor missile. For the control of a corresponding lateral acceleration according to a time profile, the explanations given above for a controllable thrust profile apply correspondingly.

In a preferred embodiment, such a parameter vector which contains at least two trajectory angles for the trajectory of the interceptor missile as two free parameters is selected as the current parameter vector (in particular also a predeterminable candidate, see above). This results in a particularly simple optimization problem for the MPC method. This also enables a particularly fast reaction to highly agile targets, so that they can be followed particularly well by the interceptor missile.

With the objects of the invention in view, there is concomitantly provided an interceptor missile. During its flight, the interceptor missile is at least temporarily propelled by its (at least one) engine and is steerable by using real steering commands. The method can continue to be used even after all engines burn out. For this purpose, it has a steering device, for example controllable rudders or lateral acceleration devices, for example control nozzles, which are operated by steering commands and used to steer the flying interceptor missile. The interceptor missile is still used to intercept a target. The interceptor missile contains a current parameter vector of free control parameters for the interceptor missile, on the basis of which, as explained above, real steering commands for the steering are generated. The interceptor missile also contains a control and evaluation unit. The control and evaluation unit is set up to carry out the method according to the invention.

The interceptor missile and at least some of its embodiments as well as the respective advantages have already been explained analogously in connection with the method according to the invention.

The control and evaluation unit is set up or adapted or configured to carry out the method according to the invention. "Set up"/"adapted"/"configured" is to be understood as meaning that the control and evaluation unit is not just suitable for carrying out the relevant steps/functions, but has rather been specially conceived for this purpose. The control and evaluation unit is "set up" accordingly, in particular by programming a computing device or fixed wiring contained therein.

The invention is based on the following findings, observations or considerations and in addition has the following embodiments. The embodiments are sometimes also called "the invention" for simplicity. The embodiments may also contain parts or combinations of the aforementioned embodiments or correspond to them and/or may include embodiments not previously mentioned.

Novel hypersonic weapons such as an HGV (hypersonic glide vehicle) or HCM (hypersonic cruise missile) form a new threat as targets, against which conventional interceptor missiles can hardly be used successfully.

The invention is based on the concept of using an interceptor missile, for example a so-called "Ramjet Interceptor" (RJI), namely a multistage missile based on a ramjet drive, against such hypersonic targets, i.e. against hypersonic weapons. The invention is further based on the concept of creating a steering concept for the midcourse phase of such an interceptor missile. While there are different concepts for the endgame, which are mostly based on recognizing the target maneuver and directly connecting it to the steering of the interceptor missile, the midcourse phase of existing concepts is limited to the best possible determination of the point of encounter (predicted intercept point=PIP) and the trajectory to it. For the new target class of potentially strongly maneuvering hypersonic glide vehicles (HGV) or hypersonic cruise missiles (HCM), the PIP approach is not sufficient, since the approach of the interceptor missile takes a comparatively long time and the target can build up large deviations from an originally suitable PIP during this time.

So far, steering in the midcourse phase has mostly been based on the PIP approach. This is determined with the aid of all available a priori knowledge of the respective weapon system and the interceptor missile has only the task of approaching this PIP and ensuring a handover from the instructing sensor of the weapon system (radar) to the on-board sensor (seeker head).

According to a more flexible approach, the interceptor missile determines its own PIP. In any case, significant target maneuvers in the midcourse phase result in a relocation of the PIP and thus a deviation from the original optimal trajectory. Therefore, novel methods are based on classifying target maneuvers that are highly insignificant as such and avoiding unnecessary PIP relocation and the associated energy loss. A concept for the explicit handling of maneuvering targets in the midcourse phase is the object of the present invention. As mentioned above, there are a variety of well-known solutions regarding endgame steering or terminal guidance.

The MPC approach in embodiments of the present invention is not only to predict the target and interceptor trajectories (trajectories of the target and the interceptor missile) with a ZEM predictor, but to optimize suitable control parameters by using numerical, real-time capable search methods, for example in every nth steering cycle. The prediction of target and interceptor movement, especially based on the zero-effort approach, is a well-known concept. When predicting the target trajectory, the estimated target accelerations can be applied using game-theory hypotheses. In a conceivable realization, for example, the goal can be adopted to minimize the approach speed of the interceptor with the current maneuver (evasive maneuver). The method is based on the concept of free control parameters which are to be optimized. In a first approach, these can be the trajectory angles of the interceptor at the current time. Once the optimization has determined the optimal trajectory angles, these can be interpreted as a target trajectory angle (changed current parameter vector) and commanded in the form of trajectory steering (generation of the real steering commands).

The optimization can use a cost function (quality) similar to an offline procedure (determination of the trajectory by a steering system outside the interceptor missile). Criteria such as minimum deviation, maximum terminal speed, minimum remaining flight time (time to go=Tgo), as well as geometric requirements such as certain impact angles can be used in the cost function. In further realizations, for example, the ignition timing of a second engine pulse can be used as a parameter to be optimized. Finally, it is possible to discretize the controllable thrust of a jet, ramjet or gel engine in time (sequence of sub values) and to determine it optimally in terms of MPC by iteration.

Other features which are considered as characteristic for the invention are set forth in the appended claims.

Although the invention is illustrated and described herein as embodied in an interceptor missile and a method for steering the interceptor missile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE FIGURE

The FIGURE of the drawing is a block diagram showing the principle method according to the invention.

DETAILED DESCRIPTION OF THE INVENTION

Referring now in detail to the single FIGURE of the drawing, there is seen an illustration of a method for steering an interceptor missile 2, which is propelled by an engine 4, in this case controllable in its thrust, and steerable, by controlling tailplanes, in a manner not shown in detail. The steering is carried out by an implementation, which is not explained in detail, of real steering commands 6 in the interceptor missile 2 on the engine 4 and the tailplanes. The interceptor missile 2 is used to intercept a target 8. The method is carried out exclusively in a midcourse phase PM of the flight of the interceptor missile 2, i.e. the interception of the target 8.

The steering is based on a current parameter vector 10. The parameter vector 10 contains a series, in this case three, of free control parameters SP1-3 for the interceptor missile 2. The control parameters SP1 and SP2 are trajectory angles, the control parameter SP3 is a thrust control value for the engine 4, which includes a total of five sub values SP3*a-e*. A respective remaining flight time Tgo of the interceptor missile 2 until it hits the target 8 is divided into five equal time periods. In each of these time periods, the engine 4 is controlled sequentially by a corresponding thrust control value SP3*a-e*.

At the beginning of the procedure, the launch phase of the interceptor missile 2 has just ended and the midcourse phase PM begins. When entering the midcourse phase PM, a current parameter vector 10 is available. At respective steering times, in this case every 10 ms, a respective real steering command 6 is generated from the parameter vector 10 and the interceptor missile 2 is steered based on these steering commands 6.

The method begins with a step a) in which a predeterminable parameter vector 15 is selected as the current candidate 12 of an MPC optimization procedure or method 14. In the present case, the demand is generated in such a way that the current parameter vector 10 available from the end of the starting phase is used as a predeterminable parameter vector 15. The MPC optimization procedure or method 14 is used to determine an improved parameter vector to replace the current parameter vector 10.

Now the MPC optimization procedure 14 begins. Within this procedure (step or loop b)) a set of 16 possible candidates 18*a-c* is determined, three in this case in the example, each with assigned quality values 20*a-c*. Each of the candidates 18*a-c* is a possible parameter vector that could replace the parameter vector 10 if this would promise better mission success than the current actually available parameter vector 10.

Based on the current candidate 12, a modified ZEM procedure 22 is now carried out in a step c1): In a step or a loop d1) the following steps are performed iteratively at respective step times t1, 2, 3, . . . :

In a step d2) a possible intercept trajectory 24 of the interceptor missile 2 is predicted. For this purpose, virtual steering commands 7 (corresponding to the real steering commands 6) are determined based on the current candidate 12 at the respective step times t1, 2, 3, . . . , so that respective predicted locations (circles in the FIGURE) of the interceptor missile 2 result. The trajectory 24 results from the temporal or spatial sequence of the locations. In other words, how the interceptor missile 2 would move if the current candidate 12 were to be used as a parameter vector 10 for its steering is simulated iteratively.

Furthermore, in a step d3) corresponding to the step times t1, 2, 3, . . . locations and thus iteratively a target trajectory 28, i.e. a trajectory of the target 8, are predicted, but in this case taking into account a respective hypothetical flight maneuver 26 of the target 8. For example, it is assumed that the target 8 flies a certain evasive trajectory to be adopted to elude the interceptor missile 2.

According to a step or a loop d4), steps d2) and d3) are repeated iteratively for as many points in time t1, 2, 3, . . . until a ZEM approach 30 of the interceptor trajectory 24 and the target trajectory 28 is reached. This concludes the ZEM procedure 22.

The available results 32 of the ZEM method 22 in the example are the achievable ZEM approach 30, an updated remaining flight duration Tgo, the impact velocity and the angle of impact of the interceptor missile 2 on the target 8, etc.

In a step c2), a current quality value 33 is determined on the basis of these results 32 for the respective candidate 12 and is assigned to it. The assignment is based on a quality criterion 36.

In a step c3), the current candidate 12 is stored together with its determined property value 33 in the set 16 as a candidate 18*a-c* with a quality value 20*a-c*. In the first run, the quality value 20*a* is assigned to the candidate 18*a*, in later runs the quality value 20*b* is assigned to the candidate 18*b* and stored in the set 16, and so on.

In a step c4), an end criterion 38 for the optimization procedure 14 is now checked. If this is not achieved, in step e1) the current candidate 12 is varied to a varied candidate 42 using an MPC search method 40. This is adopted as the current candidate 12 in a step e2) and the MPC optimization procedure 14 is started again with the now optimized or modified candidate 12.

In the example, the optimization procedure 14 is run through three times, so that the result is three candidates 18*a-c* with assigned quality values 20*a-c*. Then the end criterion 38 is reached, in this case the fixed number of three procedure runs.

Since the end criterion 38 has been reached, the procedure returns to step a) to calculate a new set 16.

The procedure ends or is terminated when the midcourse phase PM is completed.

During the duration of the procedure, one of the candidates 18*a-c* is selected at a predetermined correction time TK according to a correction criterion 44 and henceforth used as the current parameter vector 10 for the real steering of the interceptor missile 2. In the example, the correction time TK is the achievement of the end criterion 38. The correction criterion 44 is the selection of the candidate 18*a-c* from the set 16 to which the best quality value 20*a-c* in the current set 16 is assigned.

An alternative possibility is to select step c3) as the correction time TK and (from the second check/determination of the quality value) to make the best of the previously checked candidates 18*a-c* the parameter vector 10. The best one is the one with a quality value 20*b-c* better than the quality values 20*a-c* of the candidates 18*a-c* previously present in the set 16.

In the present case, step a) also determines a currently predicted remaining flight time Tgo of the interceptor missile 2 to the target 8 in order to have a time base for the utilization of the control parameters SP3*a-e* in the step d2). An updated remaining flight time Tgo is also available as part of the results 32 at the end of each run of the ZEM procedure 22 and can be used henceforth.

The current parameter vector 10 is available in the interceptor missile 2. The interceptor missile 2 also contains a control and evaluation unit 50, in this case a central computer, which is set up to carry out the method according to the invention. The "setting up" is caried out in this case by appropriately powerful hardware and programming for implementation of the method.

The following is a summary list of reference numerals and the corresponding structure used in the above description of the invention.

REFERENCE SIGN LIST

2 Interceptor missile
4 Engine
6 Steering command (real)
7 Steering command (virtual)
8 Target
10 Parameter vector (current)
12 Candidate (current)
14 MPC optimization method
15 Parameter vector (predefinable)
16 Set
18*a-c* Candidate
20*a-c* Quality value
22 ZEM procedure
24 interceptor trajectory
26 Flight maneuver (hypothetical)
28 Target trajectory
30 ZEM Approach
32 Results
33 Quality value (current)
36 Quality criterion
38 End criterion
40 MPC search method
42 Candidate (varies)
44 Correction criterion
50 Control and evaluation unit
SP Control parameter
Tgo Remaining flight duration
PM Midcourse Phase
t1, 2, 3, . . . Step time
TK Correction time

The invention claimed is:

1. A method for steering a steerable interceptor missile powered by an engine for intercepting a moving target during a midcourse phase of an interception, the method comprising steps of:

steering the interceptor missile by using real steering commands generated at respective steering times based on free control parameters available as a current parameter vector;

at least one of constantly or repetitively optimizing the free control parameters in a course of the midcourse phase by using an optimization procedure for optimizing the control parameters;

carrying out the optimization procedure in parallel with an actual steering;

including at least one of newly detected information about a movement of the target or information about a flight of the interceptor missile in the optimization procedure as soon the information is available; and taking optimized control parameters into the current parameter vector once the optimized control parameters are available from the optimization procedure.

2. The method according to claim 1, which further comprises performing the optimization procedure during the midcourse phase as follows:

a) selecting a predeterminable parameter vector as a current candidate of a model predicted control optimization procedure to determine improved control parameters;

b) in the model predicted control optimization procedure, determining a set of possible candidates for an improved parameter vector with associated quality values as follows:

c1) performing a modified zero effort miss procedure based on the current candidate as follows:

d1) making iterative predictions at each step time as follows:

d2) a possible interceptor trajectory of the interceptor missile, taking into account virtual steering commands of the interceptor missile based on the current candidate, d3) a possible target trajectory of the target based on hypothetical maneuvers of the target, d4) repeating steps d2) to d3) iteratively until achieving a modified zero effort miss approach of the interceptor trajectory and the target trajectory, c2) based on results of the modified zero effort miss procedure, determining a current quality value based on a quality criterion and assigning the current quality value to the current candidate;

c3) successively placing the current candidate in the set as a first or further candidate together with the current quality value as an assigned quality value;

c4) upon not yet reaching an end criterion of the optimization:

e1) using a model predicted control search procedure to vary the current candidate to a varied candidate, e2) henceforth adopting the varied candidate as the current candidate and continuing the procedure with step c1), c5) upon achieving the end criterion, proceeding with the method as follows:

f) returning to step; and during the midcourse phase at predetermined correction times, selecting one of the candidates according to a correction criterion and replacing the current parameter vector with a selected candidate in order to transfer optimized control parameters into the current parameter vector as a result.

3. The method according to claim 2, which further comprises selecting the achievement of the end criterion in step c5) as the correction time, and selecting the candidate from the set to which a best quality value is assigned as the correction criterion.

4. The method according to claim 2, which further comprises selecting step c3) as the correction time, and additionally in step c3) also adopting as the correction criterion the current candidate just stored as a candidate as the current parameter vector when its assigned quality value is a best of all quality values available in the set so far.

5. The method according to claim 2, which further comprises in step e1) carrying out the variation to a varied candidate at least partially based on the candidates so far and the quality values of the candidates.

6. The method according to claim 2, which further comprises including in the quality criterion, at least as a sub criterion, a minimum deviation from the target, a maximum final speed when hitting the target, a minimum remaining flight time to the target, and a desired angle of impact on the target.

7. The method according to claim 2, which further comprises in step a) additionally determining a currently predicted remaining flight time of the interceptor missile until an end of a mission of the interceptor missile.

8. The method according to claim 7, which further comprises using as the current parameter vector a parameter vector for which at least one of the free control parameters is a value oriented to the remaining flight time or a sequence of sub values oriented to the remaining flight time.

9. The method according to claim 8, which further comprises for a variant of the sequence of sub values:

in step d2) taking the predicted remaining flight time into account by dividing the predicted remaining flight time into a predetermined number of time periods in the modified zero effort miss procedure, and for each time period taking a respective different one of the sub values into account.

10. The method according to claim 7, which further comprises providing at least one of the values or sub values as an ignition time dependent on the remaining flight time of a respective first or further combustion stage of the engine or engines of the interceptor missile.

11. The method according to claim 7, which further comprises providing at least one of the values or sub values as a thrust control value dependent on the remaining flight time for the engine of the interceptor missile controllable with respect to a thrust of the engine.

12. The method according to claim 7, which further comprises providing at least one of the sub values as a control value dependent on the remaining flight time for a lateral acceleration element of the interceptor missile.

13. The method according to claim 2, which further comprises selecting as the current parameter vector a parameter vector containing at least two trajectory angles for the trajectory of the interceptor missile as two free parameters.

14. The method according to claim 1, which further comprises providing the engine of the interceptor missile as a solid booster or a dual-pulse engine or a steerable engine.

15. An interceptor missile propelled by an engine, steerable by real steering commands, used to intercept a target and containing a current parameter vector of free control parameters for the interceptor missile, the interceptor missile comprising:

a control and evaluation unit configured to carry out the method according to claim 1.

* * * * *